US005713698A

United States Patent [19]

Worsley

[11] Patent Number: 5,713,698

[45] Date of Patent: Feb. 3, 1998

[54] SYNTHETIC BOOMSTICK COUPLING SYSTEM

[75] Inventor: Ralph Stanley Worsley, Nanoose Bay, Canada

[73] Assignees: MacMillan Bloedel Limited, Vancouver; Canadian Boomstick Company Ltd., Surrey, both of Canada

[21] Appl. No.: 629,653

[22] Filed: Apr. 9, 1996

[51] Int. Cl.[6] ..... E02B 15/04

[52] U.S. Cl. ..... 405/60.5; 280/515; 405/72

[58] Field of Search ..... 405/72, 71, 63–70, 405/60.5, 60, 61; 172/272, 273; 24/68 CD; 280/515, 504

[56] References Cited

U.S. PATENT DOCUMENTS

| | | | |
|---|---|---|---|
| 1,402,608 | 1/1922 | Higdon | 172/272 |
| 2,444,876 | 7/1948 | Kuhl | 280/515 X |
| 2,482,907 | 9/1949 | Hagen | 280/515 X |
| 2,760,789 | 8/1956 | Wampler | 280/515 X |
| 3,007,718 | 11/1961 | Backof | 280/515 |
| 3,499,290 | 3/1970 | Smith | 405/72 |
| 3,848,417 | 11/1974 | Smith et al. | 405/72 X |
| 3,998,472 | 12/1976 | Tretter | 280/515 |
| 4,671,528 | 6/1987 | Thompson | 280/515 X |
| 5,006,014 | 4/1991 | Greenough . | |
| 5,439,315 | 8/1995 | MacKenzie et al. . | |

*Primary Examiner*—Dennis L. Taylor
*Attorney, Agent, or Firm*—C. A. Rowley

[57] ABSTRACT

A system for coupling synthetic boomsticks having a pair of spaced parallel substantially horizontal coupling flanges projecting axially therefrom. The flanges form a loop receiving space therebetween and a coupling pin passes through this space between the flanges to lock a loop therein. The coupling pin is lockable in closed position to hold loop in place. A coupling pin and slot prevents rotation of the coupling pin except when the coupling pin is in retracted open position.

18 Claims, 2 Drawing Sheets

FIG. 1
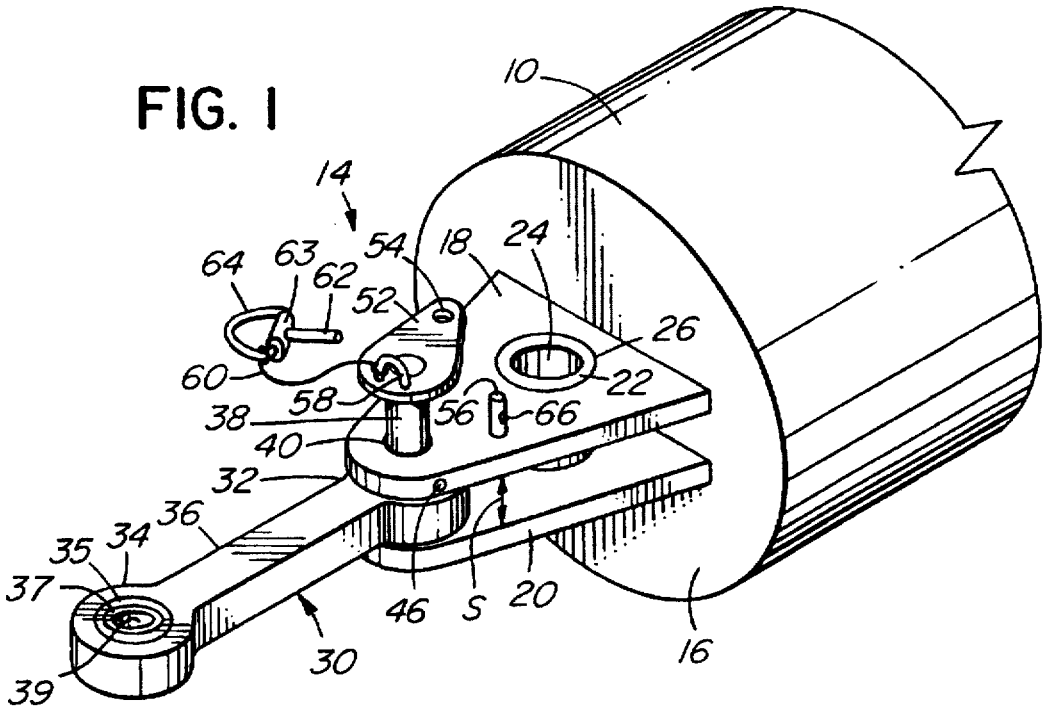
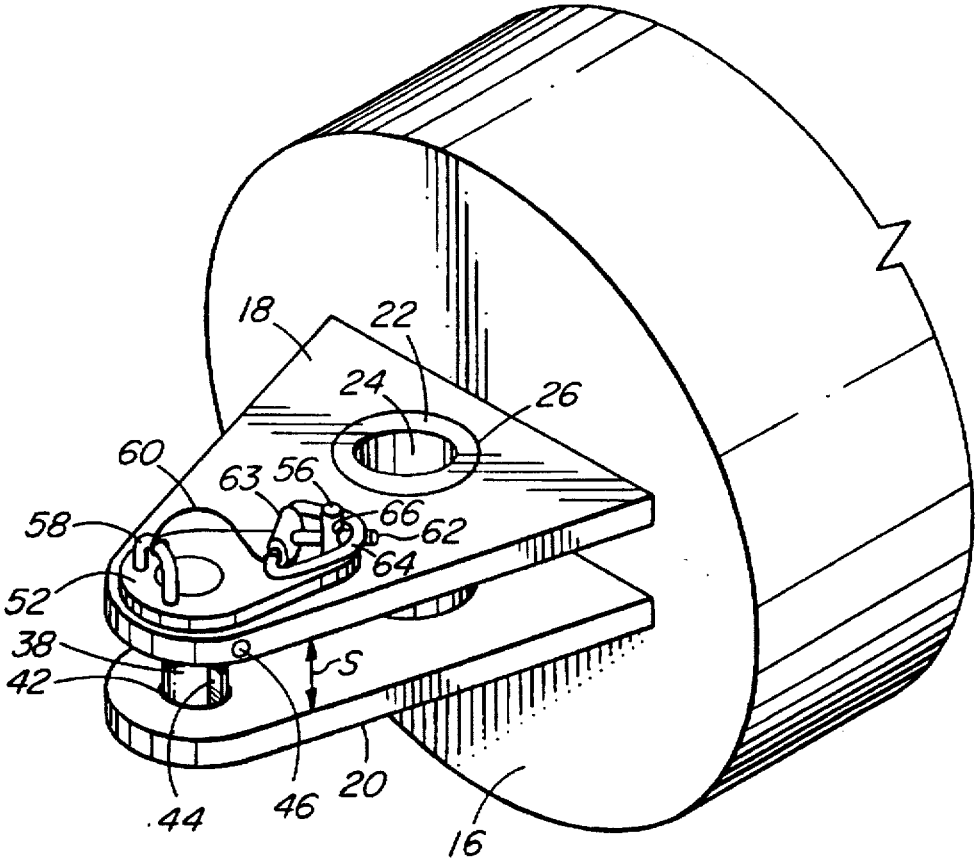
FIG. 2

FIG. 3
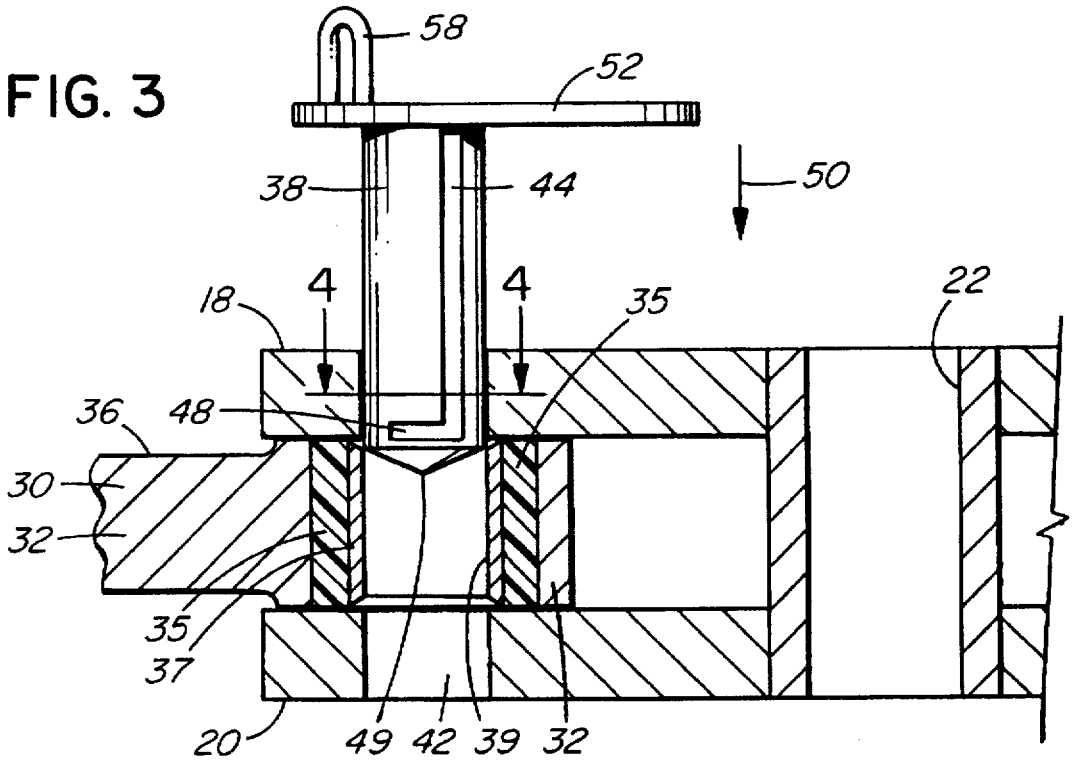
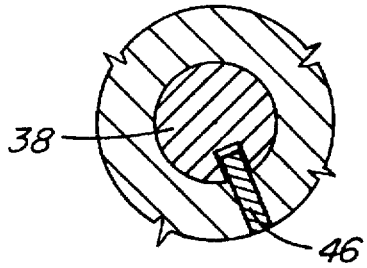
FIG. 4
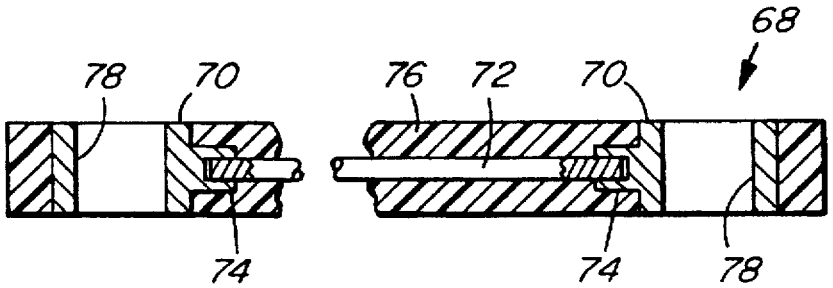
FIG. 5

SYNTHETIC BOOMSTICK COUPLING SYSTEM

FIELD OF INVENTION

The present invention relates to synthetic boomsticks, more particularly, the present invention relates to a system for coupling synthetic boomsticks.

1. Background of the Invention

The use of synthetic boomsticks has been suggested (see in U.S. Pat. No. 5,006,014 issued Apr. 9, 1991 to Greenough and U.S. Pat. No. 5,439,315 issued Aug. 8, 1995 to MacKenzie et at.) which describe two different forms of synthetic boomstick. These boomsticks are intended to simply replace the conventional wooden boomstick to save the wood and extend the life of the boomstick so that there was a net saving in the cost to the user.

The same coupling system has been used with synthetic boomsticks as is normally used with conventional wooden boomsticks, namely, a chain extending through holes in adjacent boomsticks to hold the ends of these boomstick adjacent to one another. Obviously, the chain connection permits relative movement of adjacent ends of the two adjacent boomsticks substantially equal in all the directions.

This coupling system when used with synthetic boomsticks has not been particularly successful due in part to the fact that the boomsticks are free to move relative to each other which causes collisions and in some cases damage to the synthetic boomstick. The stability of the synthetic boomstick for walking upon is also not enhanced by the use of chains. Synthetic boomsticks are significantly lighter in weight than the conventional wooden boomsticks they replace and thus each boomstick is prone when the chain coupling is used to be more easily moved up onto the logs by tension in the swifter wires used to bind the boom together.

2. Brief Description of the Present Invention

It is an object of the present invention to provide a simple yet effective coupling system for coupling pairs of adjacent boomsticks to form a boom.

Broadly, the present invention relates to a system of coupling synthetic boomsticks having couplers secured to and projecting in an axial direction from each axial end of said boomstick, each said coupler comprising a first flange and a second flange spaced from said first flange to define a coupling loop receiving space therebetween, a pair of axially aligned holes on an alignment axis, one of said aligned holes extending through said first flange and the other through said second flange, said pair of holes being spaced from said end of said boomstick, a coupling pin extending through at least said one hole in said first flange, means preventing rotation of said coupling pin except when said coupling pin is in a retracted open position spaced from said second flange and, means for releasably locking said coupling pin in an inserted closed position with said coupling pin passing through said one hole in said first flange and received in said other hole in said second flange.

Preferably, said coupling system will further comprise a coupling link having a coupling pin receiving loop adjacent each end of said coupling link, a tension link element to carry tension forces between said loops, and a compressible buffering material in said link to absorb compression and torsion stresses applied to said link.

Preferably, the system will further comprise a tubular connection interconnecting said first and second flanges and positioned between said aligned pair of holes and an adjacent said end of said boomstick, said tubular connection having its longitudinal axis substantially parallel to said alignment axis of said holes.

Preferably, outer dimensions of said tubular connection and said loop are sized so that positioning an outer surface of said loop against said outer surface of said tubular connection facilitates insertion of said coupling pin into said loop.

Preferably, said means for preventing rotation comprises an axially extending groove in said coupling pin, said groove extending substantially parallel to said alignment axis of said holes and a guide pin extending from said first flange into said groove, said groove having a circumferentially extending portion adjacent to an end of said coupling pin adjacent to said second flange when said coupling pin is in said inserted closed position.

Preferably, said means to lock comprises a flange extending radially from an end of said coupling pin adjacent to said first flange when said coupling pin is in said inserted closed position, a hole with its axis substantially parallel to said alignment axis of said holes in said flange adjacent to a free end of said flange remote from said coupling pin, and a locking pin projecting from said first flange in a position to be received within said locking hole Preferably the system will further comprise a latch pin receiving hole extending across said locking pin and a latch pin insertable through said hole to trap said locking flange between said first flange and said locking pin when said locking pin projects through said locking hole.

BRIEF DESCRIPTION OF THE DRAWINGS

Further features, objects and advantages will be evident from the following detailed description of the preferred embodiments of the present invention taken in conjunction with the accompanying drawings in which;

FIG. 1 is a schematic isometric view illustrating a end of a boomstick with a coupler extending axially therefrom for interconnecting an adjacent boomstick.

FIG. 2 is an enlarged view of the coupler of FIG. 1 showing the coupling pin locked in coupling position.

FIG. 3 is an enlarged view partially in section illustrating the coupling pin, top and second flanges of the coupling and the tracking groove.

FIG. 4 is a section along the line 4—4 of FIG. 3.

FIG. 5 is a section through a preferred form of coupling link.

DESCRIPTION OF THE PREFERRED EMBODIMENTS

As shown in FIG. 1, the present invention relates to a coupling system for a pair of synthetic boomsticks, one of which is indicated at 10 and the other (not shown). Each of the boomstick(s) 10 will be provided with a coupling 14 at each end (only one shown for the boomstick 10).

The coupling 14 is connected to the axial end, i.e. the end cap 16 of the boomstick 10, for example, by welding or the like. Each such coupling 14 includes a first flange 18 and a second flange 20 connected together by a tubular connector 22, having a hollow 24 center. The tube 22 extends through a pair of axially aligned holes 26 and 28 in the flanges 18 and 20 respectively and may be welded therein. It is preferred that the coupling 14 and end cap 16 be cast as a unit (i.e. the end cap 16, flanges 18 and 20, and the tube 22 be cast as a unit as opposed to welding). The space, as indicated by the dimension s between the flanges 18 and 20, provides clearance for receiving a loop end of coupler link 30 of FIGS. 1 and 3 (or 68 FIG. 5) for connecting a pair of adjacent boomsticks as will be described below.

The coupler link 30 shown in FIGS. 1 and 3 is formed by a pair of interconnected closed loops 32 and 34 one adjacent to each axial end of the link 30 and interconnected by a rigid link element 36. The inside of the hole 31 in each of loops 32 and 34 is secured to and encircles a resilient shock absorbing sleeve 35 which in turn is secured to and encircles a bushing 37 having a pin receiving passage 39.

The bone shaped coupling element 30 will preferably be formed by a casting operation. The length of the coupling element 30 between the centers of loops 32 and 34 will generally be correlated with the diameter of the boomsticks so that the a pair of adjacent boomsticks coupled together by a coupling link 30 may be arranged in side to side relationship with their axes substantially parallel. The coupling links 30 permit limited relative movement between the adjacent ends of a pair of adjacent synthetic boomsticks 10 (only one shown) but transfers forces in the planes of the axes of the pins 38 buffered by the resilient sleeve 35.

FIG. 5 shows a preferred form of coupling link 68 composed of a pair of loops or sleeves 70 coupled together by a suitable flexible cable or the like 72 (in place of the rigid link 36 of the FIG. 1 and 3 embodiment) which is connected to the sleeves in any suitable manner, for example, via a flange 73. Cable 72 is completely encased in a resilient material 76 which preferably also encases the outside of the sleeves 70. This encasing material 76 preferably is made of rubber or plastic with high compression strength and that is not affected by water or salt water. This material 76 tends to keep the sleeves 70 separated by a preselected distance, i.e. tends to keep the cable 72 taut yet is sufficiently resilient that it may be compressed to absorb impact and to permit limited binding, i.e. permit flexing of the cable 72 to better accommodate movement of the adjacent boomsticks 10.

Obviously, the coupling link 68 shown in FIG. 5 will be used in place of the link 30 shown in FIG. 5 so that the hole 78 of each of the sleeves 70 as will be described is adapted to receive the pin 38 of its adjacent boomstick (in the same manner as the pin 38 is received in the bore 39).

Each of the couplings includes a coupling pin 38 that is received in a pair of axially aligned holes 40 and 42 in the top and second flanges 18 and 20 respectively. An axial groove 44 extends along the shaft of the pin 38 and receives a guide pin 46 therein (see FIGS. 3 and 4) so that the coupling pin 38 throughout the majority of its travel, is prevented from rotation about its longitudinal axis yet is free to move axially. The pin 38 may only be rotated when in it is retracted open position and the guide pin 46 is aligned with circumferentially extending portion 48 of the groove 44 adjacent to the free or bottom end of the coupling pin 38. Such rotation of the pin 38 moves the guide pin 46 along section 48 to the position shown in FIG. 1 which prevents the coupling pin 38 from moving axially until it is turned around it axis to align the axial groove 44 with the guide pin 46. In this manner the coupling pin 38 is held in open receiving position for insertion of one looped end 32, 34 or 70 of the coupling link 30 or 68 and with the loop 32, 34 or 70 in position the pin 38 is rotated and then moved axially to slide the pin 38 through the bushing 37 or passage 78 and connect the connector 30 or 68 to the boomstick 10.

The loop 32 (or 34 or 70) is dimensioned and the outside of the wall of the tube 22 is positioned so that when the pin 38 is in open position and the loop 32 (or 34 or 70) is moved into the space s and the end of the link 30 or 68 (loop 32 or 34 or 70) is abutting the outside of the tube 22, the pin 38 is positioned to facilitate insertion into the bore 39 of the bushing 37 or the passage(s) 78 in the sleeve(s) 70. The pin 38 may then be rotated in a direction to align the aligning or guide pin 46 with the axial portion 44 of the slot so that the pin 38 may now move axially as indicated by the arrow 50 in FIG. 3. the tapered or conical end 49 of the pin 38 facilitates entry of the pin 38 into the bore 39 of the bushing 37 or 78 of the sleeve 70.

Fixed to the top of the pin 38 is a locking flange 52 which has a locking hole 54 having its axis substantially parallel to the longitudinal axis of the pin 38. Projecting from the top of the first flange 18 is a locking projection or pin 56 which, when the coupling pin 38 is rotated to a position to permit same to move in the direction 50, (see FIG. 3) aligns the projection or pin 56 with the locking hole 54 so that when the pin 38 moves to its insert closed position as indicated in FIG. 2, the pin 56 extends through the hole 54 and projects above the flange 52.

Tethered to a loop 58 on the flange 52 via lanyard 60 is a latch pin 62 which is lockable to the post 56 as will be described below by a latch ring 64. In closed position, the latch pin 62 is passed through a hole 66 having its axis substantially perpendicular to the axis of the coupling pin 38 and the latch loop 64 which extends from the ranged end 63 of latch pin 62 and in closed position is folded over on top of the free end of the pin 62 (end remote from the flange 63) and encircles the top of the post 56 thereby to lock the latching pin 62 in position locking the coupling pin 38 in closed position.

This type of latching pin is known in the trade as a linchpin and its operation is well understood.

It will be apparent that in water conveying of logs, many of the operations have to be performed at a significant distance from the logger by using a long rod with a hook on the end. Thus, in operation, the lanyard 60 will be caught by a hook, the latch loop or ring 64 flipped over from the position shown in FIG. 2, the pin 62 withdrawn from the hole 66. The loop 58 may be used to pull the coupling pin 38 to the open position and when the pin is in open position, to turn the pin 38 to the position shown in FIG. 1 to lock the pin 38 in the retracted open position. The loop 32 (or 34 or 70) may then be inserted or withdrawn from the space s of the coupler 14 to uncouple the end of the boomstick 10.

The passage 24 through the connecting tube at 22 also permits the use of a hook on the end of a rod to manipulate the end of the boomsticks to bring the boomstick into position for the coupling operation as above described.

Having described the invention, modifications will be evident to those skilled in the art without departing from the scope of the invention as defined in the appended claims.

We claim:

1. A system of coupling a pair of synthetic boomsticks having couplers secured to and projecting in an axial direction one from each axial end of each said boomstick, each said coupler comprising a first flange and a second flange spaced from said first flange to define a loop receiving space therebetween, a pair of axially aligned holes aligned on an alignment axis, one of said aligned holes extending through said first flange and the other through said second flange, said pair of holes being spaced from its adjacent said end of said boomstick, a coupling link having a coupling pin receiving loop adjacent each of its ends, a tension link element interconnecting said loops to carry tension forces between said loops, and a compressible buffering material encasing said tension link, a coupling pin extending through at least said one hole in said first flange and through an adjacent coupling pin receiving loop of said coupling link and, means for releasably locking said coupling pin in an inserted closed position with said coupling pin passing through said one hole in said first flange, said coupling pin using loop and received in said other hole in said second flange.

2. A coupling system as defined in claim 1 further comprising means preventing rotation of said coupling pin except when said coupling pin is in a retracted open position spaced from said second flange.

3. A coupling system as defined in claim 2 further comprising a coupling link having a coupling pin receiving loop adjacent each end of said coupling link, a tension link element to carry tension forces between said loops, and a compressible buffering material encasing said tension link.

4. A coupling system as defined in claim 1 further comprising a coupling link having a coupling pin receiving loop adjacent each end of said coupling link, said coupling link having a rigid member connecting said pin receiving loops.

5. A coupling system as defined in claim 2 further comprising a coupling link having a coupling pin receiving loop adjacent each end of said coupling link, each said coupling link having a rigid member connecting said pin receiving loops.

6. A coupling system as defined in claim 1 further comprising a tubular connection interconnecting said first and second flanges and positioned between said aligned pair of holes and an adjacent said end of said boomstick, said tubular connection having its longitudinal axis substantially parallel to said alignment axis of said holes.

7. A coupling system as defined in claim 2 further comprising a tubular connection interconnecting said first and second flanges and positioned between said aligned pair of holes and an adjacent said end of said boomstick, said tubular connection having its longitudinal axis substantially parallel to said alignment axis of said holes.

8. A coupling system as defined in claim 3 further comprising a tubular connection interconnecting said first and second flanges and positioned between said aligned pair of holes and an adjacent said end of said boomstick, said tubular connection having its longitudinal axis substantially parallel to said alignment axis of said holes.

9. A coupling system as defined in claim 4 further comprising a tubular connection interconnecting said first and second flanges and positioned between said aligned pair of holes and an adjacent said end of said boomstick, said tubular connection having its longitudinal axis substantially parallel to said alignment axis of said holes.

10. A coupling system as defined in claim 5 further comprising a tubular connection interconnecting said first and second flanges and positioned between said aligned pair of holes and an adjacent said end of said boomstick, said tubular connection having its longitudinal axis substantially parallel to said alignment axis of said holes.

11. A coupling system as defined in claim 3 wherein an outer dimensions of said connection and said link are sized so that positioning an outer surface of said link against said outer surface of said connection facilitates insertion of said coupling pin into said loop.

12. A coupling system as defined in claim 2 wherein said means for preventing rotation comprises an axially extending groove in said coupling pin, said groove extending substantially parallel to said alignment axis of said holes and a guide pin extending from said first flange into said groove, said groove having a circumferentially extending portion adjacent to an end of said coupling pin adjacent to said second flange when said coupling pin is in said inserted closed position.

13. A coupling system as defined in claim 3 wherein said means for preventing rotation comprises an axially extending groove in said coupling pin, said groove extending substantially parallel to said alignment axis of said holes and a guide pin extending from said first flange into said groove, said groove having a circumferentially extending portion adjacent to an end of said coupling pin adjacent to said second flange when said coupling pin is in said inserted closed position.

14. A coupling system as defined in claim 5 wherein said means for preventing rotation comprises an axially extending groove in said coupling pin, said groove extending substantially parallel to said alignment axis of said holes and a guide pin extending from said first flange into said groove, said groove having a circumferentially extending portion adjacent to an end of said coupling pin adjacent to said second flange when said coupling pin is in said inserted closed position.

15. A coupling system as defined in claim 7 wherein said means for preventing rotation comprises an axially extending groove in said coupling pin, said groove extending substantially parallel to said alignment axis of said holes and a guide pin extending from said first flange into said groove, said groove having a circumferentially extending portion adjacent to an end of said coupling pin adjacent to said second flange when said coupling pin is in said inserted closed position.

16. A coupling system as defined in claim 1 wherein said means to lock comprises a flange extending radially from an end of said coupling pin adjacent to said first flange when said coupling pin is in said inserted closed position, a hole with its axis substantially parallel to said alignment axis of said holes in said flange spaced from said coupling pin, and a locking pin projecting from said first flange in a position to be received within said locking hole when said coupling pin is in said closed position.

17. A coupling system as defined in claim 2 wherein said means to lock comprises a flange extending radially from an end of said coupling pin adjacent to said first flange when said coupling pin is in said inserted closed position, a hole with its axis substantially parallel to said alignment axis of said holes in said flange spaced from said coupling pin, and a locking pin projecting from said first flange in a position to be received within said locking hole when said coupling pin is in said closed position.

18. A coupling system as defined in claim 3 wherein said means to lock comprises a flange extending radially from an end of said coupling pin adjacent to said first flange when said coupling pin is in said inserted closed position, a hole with its axis substantially parallel to said alignment axis of said holes in said flange spaced from said coupling pin, and a locking pin projecting from said first flange in a position to be received within said locking hole when said coupling pin is in said closed position.

* * * * *